US005685580A

United States Patent [19]

West et al.

[11] Patent Number: 5,685,580

[45] Date of Patent: Nov. 11, 1997

[54] PORTABLE DOOR LOCKING DEVICE

[76] Inventors: David Maurice West; Debra Sue Caldwell, both of 25043 Ocotillo St., Moreno Valley, Calif. 92553

[21] Appl. No.: 696,166

[22] Filed: Aug. 13, 1996

[51] Int. Cl.[6] ..... E05C 19/18

[52] U.S. Cl. ..... 292/288; 292/290; 292/292

[58] Field of Search ..... 292/288, 289, 292/290, 292, 295, 294, 189, 190

[56] References Cited

U.S. PATENT DOCUMENTS

| | | | |
|---|---|---|---|
| 155,895 | 10/1874 | Smith | 292/289 X |
| 584,677 | 6/1897 | Doyle | 292/292 |
| 663,036 | 12/1900 | Mitchell | 292/292 |
| 1,074,261 | 9/1913 | Hughes et al. | 292/292 |
| 1,412,340 | 4/1922 | Cruikshank | 292/292 |
| 1,579,298 | 4/1926 | Fry et al. | 292/296 X |
| 3,181,319 | 5/1965 | Hudon | 292/289 |
| 3,854,764 | 12/1974 | Corrigan | 292/289 |
| 4,004,833 | 1/1977 | Hull | 292/288 |
| 4,605,251 | 8/1986 | Finlay | 292/288 |

FOREIGN PATENT DOCUMENTS

| | | | |
|---|---|---|---|
| 2411291 | 8/1979 | France | 292/292 |
| 2275494 | 8/1994 | United Kingdom | 292/289 |

*Primary Examiner*—Rodney M. Lindsey

[57] ABSTRACT

A portable door locking device including an attachment plate dimensioned for coupling with an existing striker plate on an existing door jamb. The attachment plate has a central aperture therethrough. A locking bar is threadable through the central aperture of the attachment plate to preclude inward opening of an existing door.

1 Claim, 3 Drawing Sheets

Fig. 1
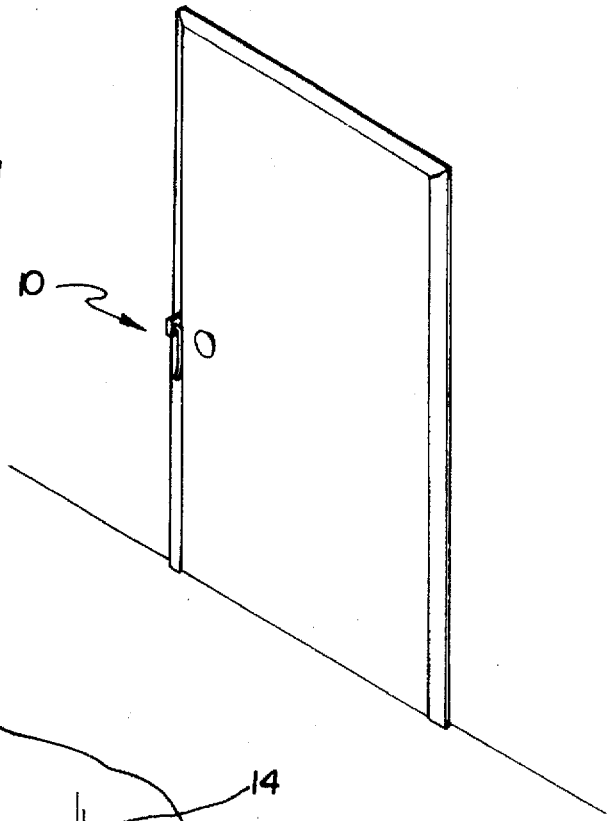
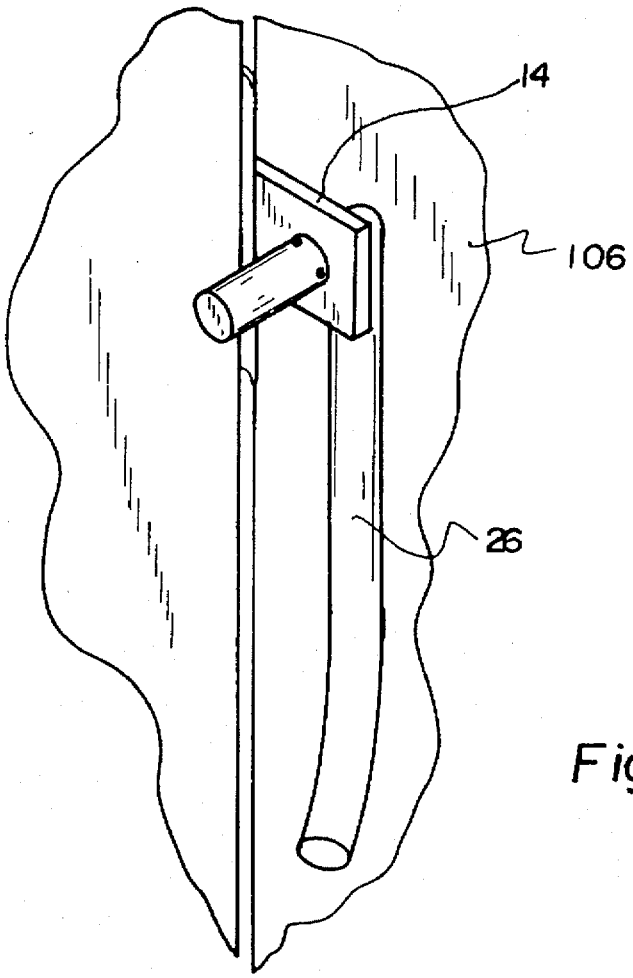
Fig. 2

PORTABLE DOOR LOCKING DEVICE

BACKGROUND OF THE INVENTION

1. Field of the Invention

The present invention relates to a portable door locking device and more particularly pertains to preventing a door without a lock from being opened with a portable door locking device.

2. Description of the Prior Art

The use of door locks is known in the prior art. More specifically, door locks heretofore devised and utilized for the purpose of locking doors are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,280,977 to Piva discloses an auxiliary door lock.

U.S. Pat. No. 5,401,068 to Barnard discloses a portable door locking mechanism.

U.S. Pat. No. Des. 343,565 to Turner discloses the ornamental design for a portable door lock.

U.S. Pat. No. 5,193,867 to Husted discloses a portable security device for a door.

U.S. Pat. No. 4,984,834 to Nickels discloses a portable security lock.

U.S. Pat. No. 4,898,411 to Ocello et al. discloses a portable door lock.

While these devices fulfill their respective, particular objective and requirements, the aforementioned patents do not describe a portable door locking device for preventing a door without a lock from being opened.

In this respect, the portable door locking device according to the present invention substantially departs from the conventional concepts and designs of the prior art, and in doing so provides an apparatus primarily developed for the purpose of preventing a door without a lock from being opened.

Therefore, it can be appreciated that there exists a continuing need for new and improved portable door locking device which can be used for preventing a door without a lock from being opened. In this regard, the present invention substantially fulfills this need.

SUMMARY OF THE INVENTION

In the view of the foregoing disadvantages inherent in the known types of door locks now present in the prior art, the present invention provides an improved portable door locking device. As such, the general purpose of the present invention, which will be described subsequently in greater detail, is to provide a new and improved portable door locking device and method which has all the advantages of the prior art and none of the disadvantages.

To attain this, the present invention essentially comprises an attachment plate comprised of a generally planar member configured into a plurality of extents. The attachment plate has a first extent. The first extent has a central aperture therethrough. A second extent extends generally orthogonally from an end of the first extent. A third extent extends generally orthogonally from a free end of the second extent. A fourth extent extends orthogonally from a free end of the third extent whereby the fourth extent and the second extent in a parallel relationship. The attachment plate is dimensioned for coupling with an existing striker plate on an existing door jamb whereby the first extent extends inwardly in an orthogonal relationship with respect to the door jamb. The device includes a locking bar comprised of a generally elongated and cylindrical member. The locking bar has a diameter essentially equal to a diameter of the central aperture of the first extent of the attachment plate. The locking bar has a central extent. An obtuse end portion extends from one end of the central extent at an angle greater than 135 degrees. The locking bar has an orthogonal end portion extending from an opposed end of the central extent at angle of about ninety degrees. The orthogonal end portion has a plurality of protrusions disposed circumferentially thereon. The locking bar is threadable through the central aperture of the first extent of the attachment plate to preclude inward opening of the existing door.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved portable door locking device which has all the advantages of the prior art door locks and none of the disadvantages.

It is another object of the present invention to provide a new and improved portable door locking device which may be easily and efficiently manufactured and marketed.

It is a further object of the present invention to provide a new and improved portable door locking device which is of durable and reliable construction.

An even further object of the present invention is to provide a new and improved portable door locking device which is susceptible of a low cost of manufacture with regard to both materials and labor, and which accordingly is then susceptible of low prices of sale to the consuming public, thereby making such a portable door locking device economically available to the buying public.

Still yet another object of the present invention is to provide a new and improved portable door locking device which provides in the apparatuses and methods of the prior art some of the advantages thereof, while simultaneously overcoming some of the disadvantages normally associated therewith.

Even still another object of the present invention is to provide a new and improved portable door locking device for preventing a door without a lock from being opened.

Lastly, it is an object of the present invention to provide a new and improved portable door locking device including an attachment plate dimensioned for coupling with an existing striker plate on an existing door jamb. The attachment plate has a central aperture therethrough. A locking bar is threadable through the central aperture of the attachment plate to preclude inward opening of an existing door.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective view of the preferred embodiment of the portable door locking device constructed in accordance with the principles of the present invention.

FIG. 2 is a perspective view of the present invention in place on a door.

The same reference numerals refer to the same parts through the various Figures.

DESCRIPTION OF THE PREFERRED EMBODIMENT

Figure 3:
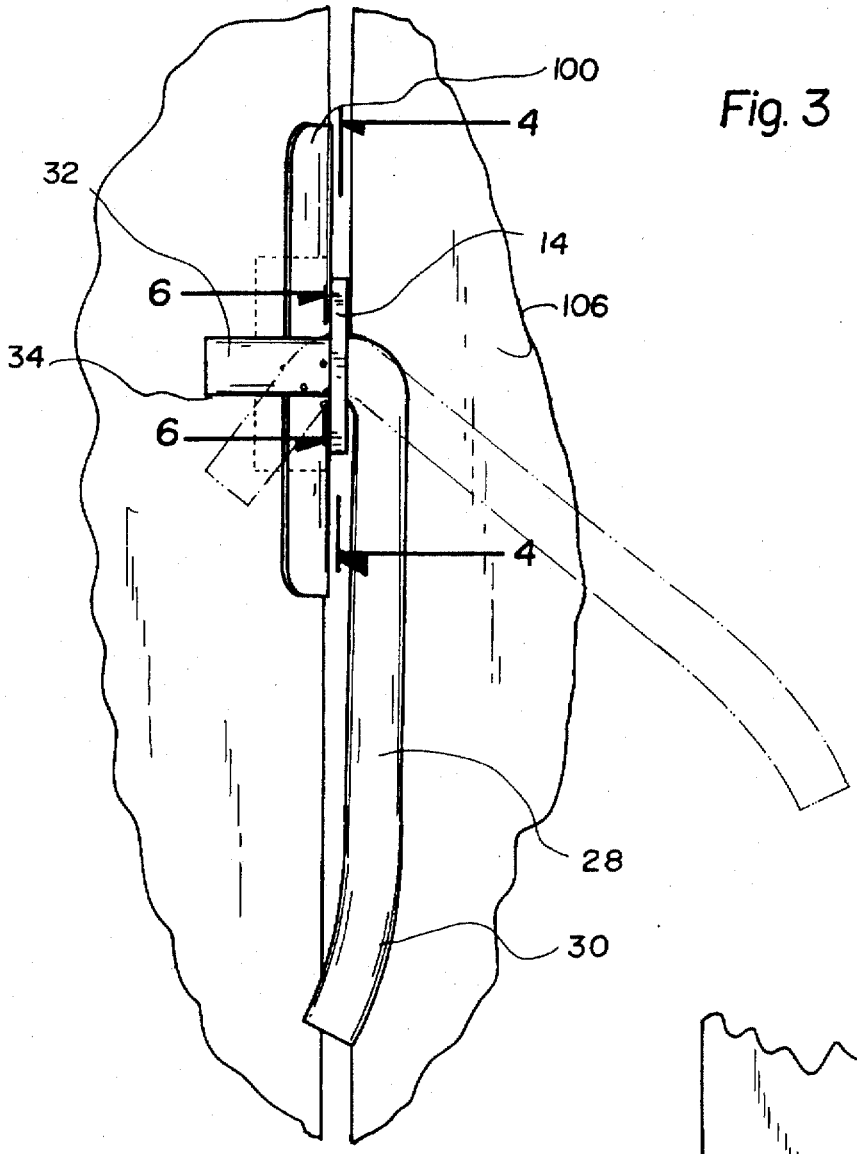
FIG. 3 is a front elevation view of the present invention illustrated in use.
Figure 4:
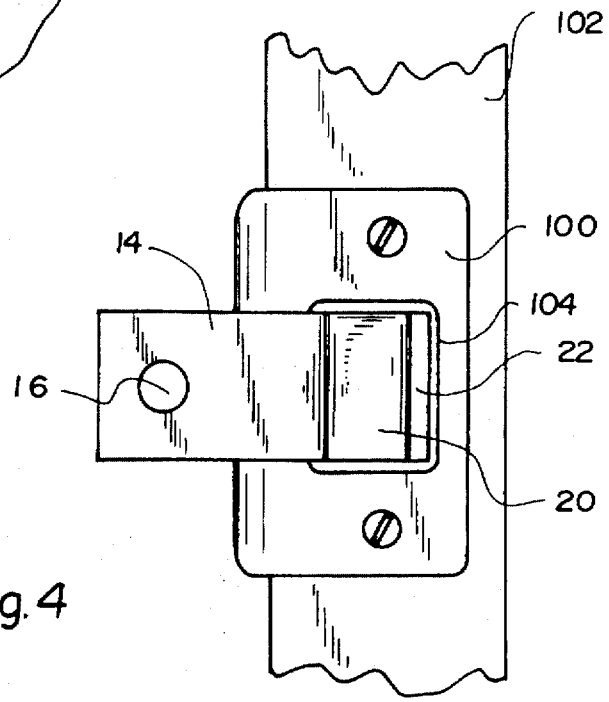
FIG. 4 is a cross-sectional view as taken along line 4—4 of FIG. 3.
Figure 5:
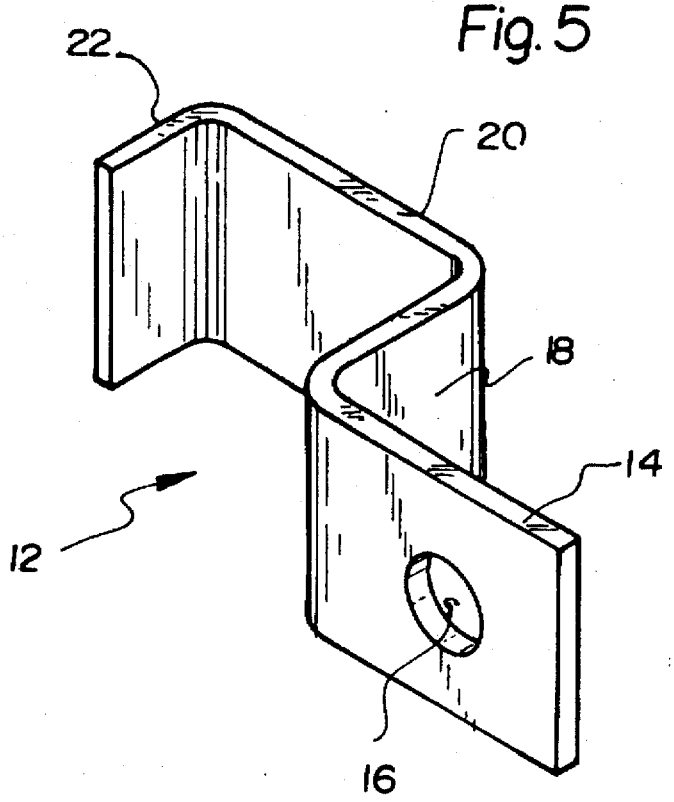
FIG. 5 is a perspective view of the attachment plate of the present invention.
Figure 6:
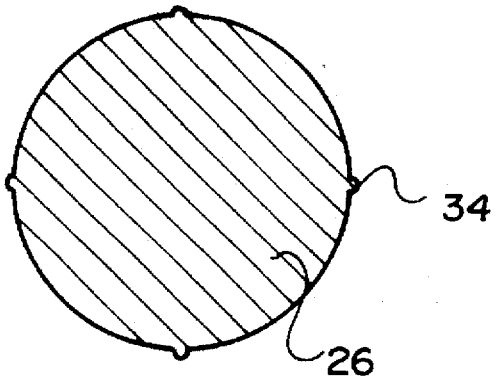
FIG. 6 is a cross-sectional view as taken along line 6—6 of FIG. 3.

With reference now to the drawings, and in particular, to FIGS. 1–6 thereof, the preferred embodiment of the new and improved portable door locking device embodying the principles and concepts of the present invention and generally designated by the reference number 10 will be described.

Specifically, it will be noted in the various Figures that the device relates to a portable door locking device for preventing a door without a lock from being opened. In its broadest context, the device consists of an attachment plate and a locking bar. Such components are individually configured and correlated with respect to each other so as to attain the desired objective.

The device 10 includes an attachment plate 12 comprised of a generally planar member configured into plurality of extents. The attachment plate 12 has a first extent 14. The first extent 14 has a central aperture 16 therethrough. A second extent 18 extends generally orthogonally from an end of the first extent 14. A third extent 20 extends generally orthogonally from a free end of the second extent 18. A fourth extent 22 extends orthogonally from a free end of the third extent 20 whereby the fourth extent 22 and the second extent 18 are in a parallel relationship. The attachment plate 12 is dimensioned for coupling with an existing striker plate 100 on an existing door jamb 102 whereby the first extent extends 14 inwardly in an orthogonal relationship with respect to the door jamb 102. Note FIG. 4. The attachment plate 12 is positioned within the striker plate 100 with the third extent 20 abutting an innermost portion of an aperture 104 the striker plate 100 and the second 18 and fourth 22 extends abutting side surfaces of the aperture 104 of the striker plate 100. Note FIG. 4. This configuration allows for the first extent 14 to extend away and substantially orthogonally from the door jamb 102. The mounting of the attachment plate 12 to the striker plate 100 will not preclude shutting of the corresponding door.

In association with the attachment plate 12, the device 10 includes a locking bar 26 comprised of a generally elongated and cylindrical member. The locking bar 26 has a diameter essentially equal to a diameter of the central aperture 16 of the first extent 14 of the attachment plate 12. The locking bar 26 has a central extent 28. An obtuse end portion 30 extends from one end of the central extent 28 at an angle greater than 135 degrees. The locking bar 26 has an orthogonal end portion 32 extending from an opposed end of the central extent 28 at angle of about ninety degrees. The orthogonal end portion 32 has a plurality of protrusions 34 disposed circumferentially thereon. Note FIG. 6. The locking bar 26 is threadable through the central aperture 16 of the first extent 14 of the attachment plate 12 to preclude inward opening of the existing door 106. In use, the obtuse end portion 30 is threaded through the central aperture 16. The locking bar 26 is threaded through the central aperture 16 until the plurality of protrusions 36 abut the central aperture 16 thereby preventing the locking bar 26 from advancing any further with respect to the attachment plate 12. Note FIG. 2. The locking bar 26 is then manipulated so that the central extent 28 is parallel with the door jamb 102. The inward opening of the door 106 is thus precluded until removal of the locking bar 26 is achieved. Note FIG. 3.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A portable door locking device for preventing a door without a lock from being opened comprising, in combination:

an attachment plate comprised of a generally planar member configured into a plurality of extents, the attachment plate having a first extent, the first extent having a central aperture therethrough, a second extent extends generally orthogonally from an end of the first extent, a third extent extends generally orthogonally from the second extent, a fourth extent extends orthogonally from the third extent whereby the fourth extent and the second extent are in a parallel relationship, the attachment plate dimensioned for removable coupling with an existing striker plate on an existing door jamb whereby the first extent may extend in an orthogonal relationship with respect to the door jamb;

a locking bar comprised of a generally elongated and cylindrical member, the locking bar having a diameter essentially equal to a diameter of the central aperture of the first extent of the attachment plate, the locking bar having a central extent, an obtuse end portion extends from one end of the central extent at an angle greater than 135 degrees, the locking bar having an orthogonal end portion extending from an opposed end of the central extent at an angle of about ninety degrees, the orthogonal end portion having a plurality of protrusions disposed circumferentially thereon, the locking bar threadable through the central aperture of the first extent of the attachment plate from the obtuse end portion to a part of the orthogonal end portion to preclude inward opening of an existing door wherein the plurality of protrusions preclude threading a remaining part of the orthogonal end portion through the central aperture thus disengagement of the locking bar from the attachment plate.

* * * * *